United States Patent [19]

Lange

[11] Patent Number: 4,892,036

[45] Date of Patent: Jan. 9, 1990

[54] COMBINATION COLLECTION AND FOLDING CYLINDER SYSTEM

[75] Inventor: Klaus-Ulrich Lange, Gersthofen, Fed. Rep. of Germany

[73] Assignee: Man Roland Druckmaschinen AG, Offenbach am Main, Fed. Rep. of Germany

[21] Appl. No.: 326,538

[22] Filed: Mar. 21, 1989

[30] Foreign Application Priority Data

Mar. 26, 1988 [DE] Fed. Rep. of Germany ..... 3810439

[51] Int. Cl.[4] ..... B41F 13/64

[52] U.S. Cl. ..... 101/240; 270/43

[58] Field of Search ..... 101/232, 236, 237, 240, 101/241, 238, 239; 270/42, 43; 493/416, 454, 425, 426, 427, 428, 429

[56] References Cited

U.S. PATENT DOCUMENTS

| | | | |
|---|---|---|---|
| 2,026,443 | 12/1935 | Tomlin | 270/42 |
| 2,797,084 | 6/1957 | Hilgoe et al. | 270/43 |
| 2,847,214 | 8/1958 | Ritzerfeld et al. | 101/240 |
| 3,166,206 | 7/1965 | Porter et al. | 101/238 |
| 3,772,990 | 11/1973 | Weisberber | 101/232 |
| 4,190,242 | 2/1980 | Bolza et al. | 270/42 |
| 4,448,125 | 4/1984 | Kawaguchi et al. | 101/232 |

FOREIGN PATENT DOCUMENTS 2537919 3/1977 Fed. Rep. of Germany .

*Primary Examiner*—Eugene H. Eickholt

*Attorney, Agent, or Firm*—Frishauf, Holtz, Goodman & Woodward

[57] ABSTRACT

To permit central control of shifting of folding blades and puncture needles on a combination collection or assembly and folding cylinder (9), the cams (23, 251) have associated therewith rotatable cam cover disks (62, 61) which are driven from the main machine drive, for example via a drive gear (20) coupled to the cylinder (9). An additional rotary motion is superimposed to permit shifting of the cover disks and thus selectively different modes of operation, for collection or assembly, or non-collection of sequential sheet products placed on the cylinder. The superimposed motion arrangement comprises a hollow coupling gear (29) which is coupled to a worm (28) coupled therewith, the worm being engaged by axially shiftable roller bolts (36, 37), the axial position of which is controllable by an electrical positioning motor (57) via a shifting plate (47) upon rotation of a positioning spindle (52).

9 Claims, 3 Drawing Sheets

COMBINATION COLLECTION AND FOLDING CYLINDER SYSTEM

The present invention relates to accessory apparatus for printing machinery, and more particularly to a collection and folding cylinder system to handle sheet products, typically and printed products from a printing machine.

BACKGROUND

Folding systems usually include a folding blade cylinder and a folding flap cylinder, which has folding flaps in which projectable folding blades from the folding blade cylinder can engage. Some of the folding blade cylinders also have puncture needles to hold sheet products on the folding blade cylinder and carries the sheet products around the folding blade cylinders.

For some operations, it is desirable to change the mode of operation of the folding blade—folding flap cylinder combination to accumulate a number of sheets on the folding blade cylinder before the folding blades are projected, so that a number of sheets can be folded at the same time.

A printing machine having a combination collection and folding blade cylinder is available commercially under the Registered Trademark "LITHOMAN", made by MAN-Roland Druckmaschinen AG, Offenbach, Fed. Rep. Germany, and distributed in the United States by M.A.N. Roland USA, Inc., of Middlesex, N.J. Change-over between the respective operating modes—folding and either assembling or collecting—is done when the machine is stopped. A bolt couping is engageable with fitting holes. A hand wheel is engageable with the main drive of the cylinder and, by rotating the hand wheel and selectively engaging the bolt coupling in the respective holes, a covering cam disk for the operating cams of the folding blades as well as a needle covering cam disk for the puncturing needles is angularly or circumferentially shifted with respect to a fixed cam disk for the folding blades and the puncturing needles. Engagement of the coupling bolts requires careful rotation of the hand wheel to ensure alignment of the coupling bolts with the respective fitting engagement holes. Change-over is possible only manually.

THE INVENTION

It is an object to provide a combination assembly or collection and folding cylinder system which permits switch-over between the respective modes of operation of the cylinder without requiring engagement, disengagement and reengagement at a shifted position of a clutch and which, further, does not require manual operation but, rather, also permits automatic operation, controllable from a central control console.

Briefly, a coupling gear is secured to a hollow shaft, the coupling gear being driven from the main drive of the machine, for example via a gear which also drives the folding blade cylinder. The covering cam disks, which adjust the positions of cam followers operating the folding blades and puncturing needles, respectively, are driven from the coupling gear with, however, an interposed arrangement which changes the relative angular position of any specific reference point on the coupling gear with respect to the drive of the cam disks. In accordance with a preferred feature of the invention, this interposed arrangement includes a worm which is positioned within a hollow shaft to which the coupling gear is attached, the worm being engaged by roller bolts coupled to the coupling gear, and axially shiftable with respect to the coupling gear, for example under control of a positioning motor, such as a stepping motor or the like. Thus, by axially shifting the engagement of the worm with the roller bolts, the relative angular position of the gearing coupling the disks via the coupling gear to the main drive of the machine, and hence to the folding cylinder, can be changed to thereby control the cam followers which, in turn, control the folding blades and puncturing needles in accordance with the desired mode of operation.

The system has the advantage that a drive gear or pinion, namely the coupling gear or pinion, is so arranged that it can be axially shifted to, by means of the worm, superimpose an additional rotation thereto, in addition to, and independently of the rotation derived from the main machine drive. The gearing and drive elements for the cylinder as well as for all other elements remain in continuous engagement. Axial shifting of the hollow coupling gear can be readily obtained from a central control console by controlling a suitable positioning motor.

DRAWINGS

DETAILED DESCRIPTION

Figure 1:
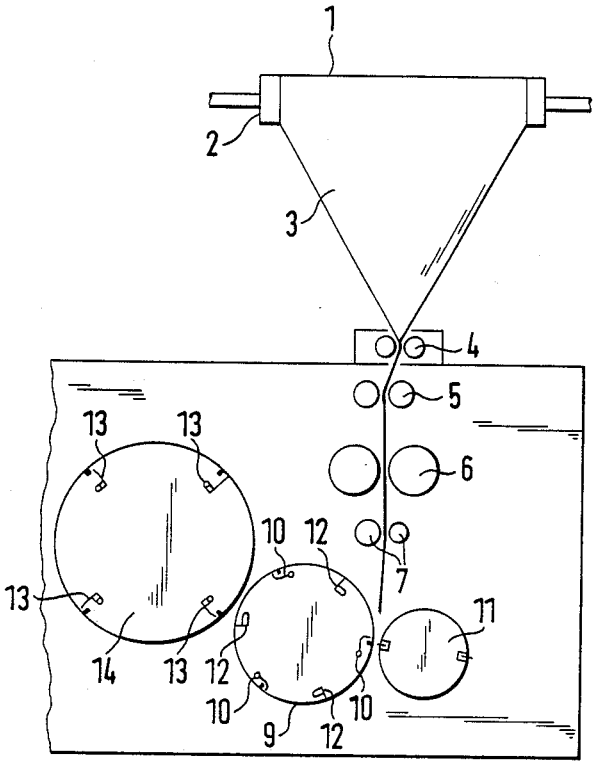
FIG. 1 is a highly schematic side view of the collection and folding system in combination with the output from a printing machine.

The output of a rotaty web printing machine is guided in form of a continuous web 1 over a folding former having an input roller 2, and a former funnel or folding triangle 3, where the web receives a first longitudinal fold. The longitudinally folded web is pinched by pinch rollers 4, pulled downwardly by a pulling or tensioning roller pair 5, and perforated longitudinally by a longitudinal perforation roller pair 7, downstream of a cross perforation roller pair 6.

The foregoing arrangement is standard in many printing machine installations.

The combination collection or assembling and folding cylinder 9, which is part of the system of the present invention, is provided to grip the leading edge of the longitudinally folded web with puncturing needles 10. Two modes of operation are then possible:

(a) Severing and transfer production:

The web is severed into sheet or severed elements by a cutting cylinder 11 having cutter knives at the circumference thereof. The puncture needles 10, having gripped the leading edge of the web, guide the now severed portions or sheet portions—folded by the folding former system 3—about the circumference of the cylinder 9. The cylinder 9 has folding blades 12 thereon which provide a cross fold for the printed product on the cylinder 9, by pushing the printed product at the point where the cross fold is to be made in opened folding flaps 13 of an associated folding flap cylinder 14.

(b) Collection or assembly and folding:

For collection or assembly of a plurality of printed products, the severed product of the web is held by the puncturing needles 10 and carried about the circumference of the cylinder 9 once more to the receiving position for another leading edge of the web. The puncturing needles 10 then receive a further portion of the web 1, and now carry both web portions, suitably severed, above each other about the cylinder until the folding blade 12, being projected, then pushes the superimposed folded sheets, in common, in a folding flap 13 of the folding flap cylinder 14.

In the arrangement illustrated, the cylinder 9 has three puncture needle systems 10 and three folding blades 12. The folding flap cylinder 14 is of substantially larger diameter and has four folding flap systems 13. These arrangements and the numbers of folding flaps and folding blades, as well as the circumferences of the respective cylinders, are used merely as an example; with respect to the invention, they are not relevant nor critical.

Subsequent apparatus, downstream from the folding flap cylinder 14, have been omitted for clarity, since they are not of interest for the subject matter of the present invention.

In accordance with the present invention, changeover between the two modes of operation (a) and (b) above can be accomplished by remote control, and without manual intervention, and further without carefully selecting suitable clutching positions.

Figure 2:
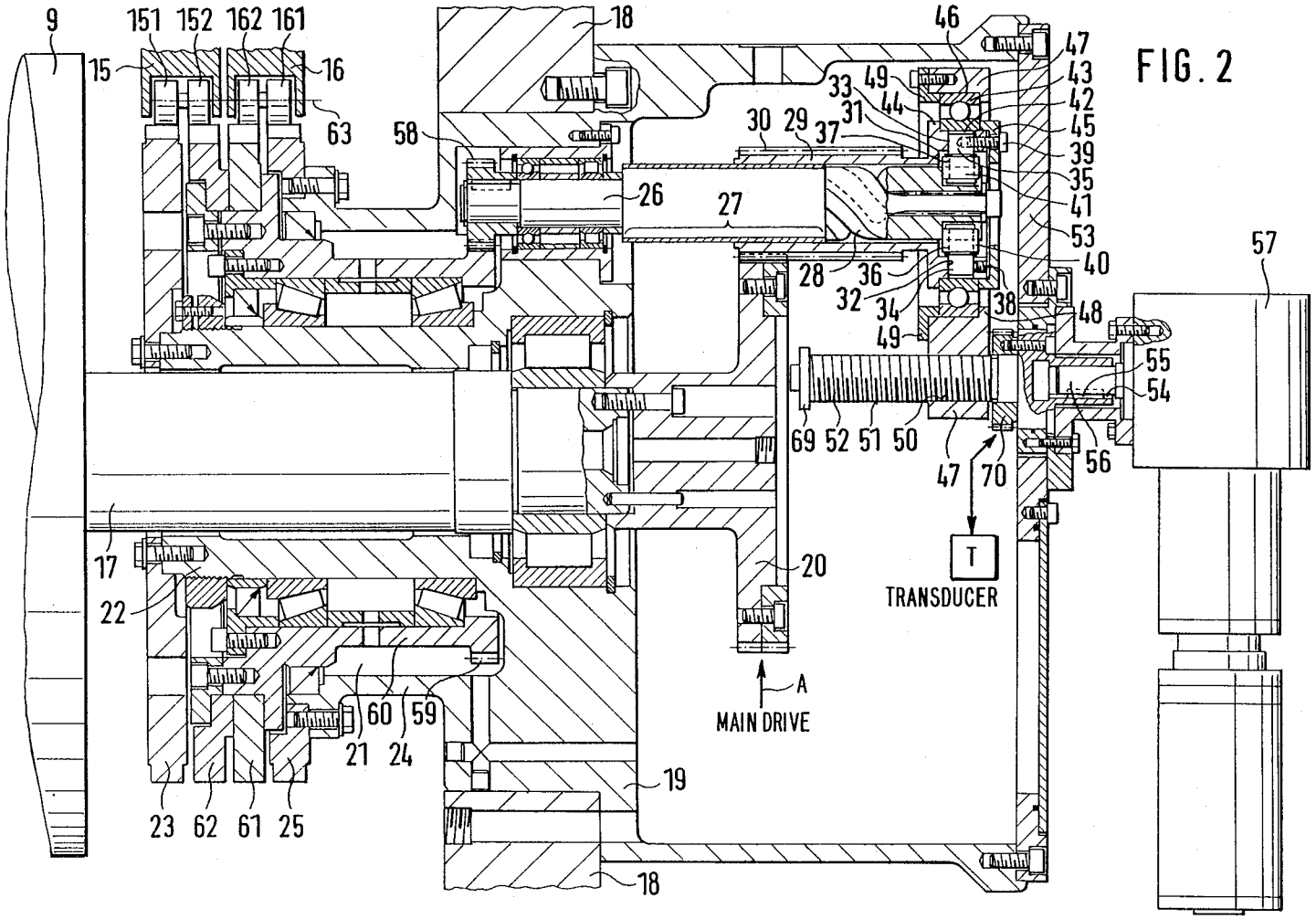
FIG.2 is a fragmentary longitudinal sectional view through the drive side of the collection or assembly and folding cylinder, and showing the drive arrangements.

Referring now to FIG. 2, which shows the drive side of the cylinder 9, in enlarged scale, and longitudinal section.

The puncturing needles 10 and the folding blades 12—not shown in FIG. 2 for simplicity—are moved by levers 15, 16 (FIGS. 3, 4) in radial direction. The levers 15, 16 are spring-loaded and have engagement rollers 151, 152 and 161, 162 to run off suitable control curves, as will be explained. The movement of the needles 10 as well as of the folding blades 12 must occur in different sequences and frequencies in depence on the mode of operation. To provide for difference in sequences, the respective control curves are formed of a fixed and a driven cam disk. The driven cam disk, in addition to rotating as the cylinder 9 rotates, can carry out a further movement in order to clearly associate the cam rises or cam depressions with the respective mode of operation, by permitting changeover between the respective operating modes upon relative rotation of the angular position of the movable cam with respect to the angular position at any instant of time, of the cylinder 9, as determined, for example, by a main drive gear therefor.

The cylinder 9 is secured to a shaft 17 which is journalled in a bushing 19 securely retained in the side wall 18 of the printing machine. The bearing bushing 19 surrounding the shaft 17 is formed as a part—double-wall structure by forming a ring groove 21 therein. The inner wall 22 of the bearing bushing 19 closely surrounds the shaft 17 and at that portion of the bushing 19, a fixed folding blade control cam 23 is secured at the end face of the bushing 19 by suitable screws. The outer wall 24 of the bushing 19 is shorter and a fixed needle control cam 25 is secured thereto.

The cylinder 9 is driven from a main drive of the printing machine, shown only schematically by the arrow A, for example by a gear, which engages gear 20 secured to the shaft 17 of the cylinder 9.

The bearing bushing 19 further provides a bearing for a shaft 26, located eccentrically with respect to the shaft 17. Shaft 26 is axially fixed in the bushing 19. Shaft 26, at the side projecting from the machine side wall 18, is formed with a clyindrical portion 27 and a further end portion 28, cut as a worm. The outer diameter of the worm 28 is slightly less than that of the cylindrical portion 27. A coupling gear 29, which is hollow, is rotatably located about the cylindrical portion 27. The coupling gear 29 has external gear teeth 30 which are driven from the main machine drive, for example via the gear 20 of the cylinder 9. The coupling gear 29 is extended outwardly by a hollow cylindrical extension portion 31. The wall of the hollow cylindrical extension 31 is formed with two diametrically opposite radial bores 32, 33, which retain stub shafts 34, 35 of two roller bolts 36, 37 in axially fixed position, by axial retention screws 38, 39. Rollers 40, 41, rotatable on the roller bolts 36, 37, yet axially fixed, are in engagement with a respective flank of the worm 28 which, for example, is formed as a double helix.

The hollow cylindrical extension 31 has a circumferential groove cut therein which retains the inner race of a ball bearing 43. The inner race is held in position by a cover 45 which is secured to the side remote from the machine side wall 18 and by a flange 44 formed on the cylindrical extension 31. The outer race of the bearing 43 is surrounded by a ring recess 46 which is located in the upper portion of a shift plate 47. The shift plate 47 extends downwardly toward the axis of the shaft 17. The recess 46 is terminated by a flange 48. A cover 49, secured at the opposite side of the flange 48, and screw-connected to the plate 47, secures the outer race of the ball bearing 43.

The shift plate 47, at its lower portion, is formed with a threaded bore 50 in which a spindle 52, having an outer thread 51, is threaded. The entire drive gear is enclosed by an outer cover 53, through which the spindle 52 can pass, retaining the spindle rotatable therein, but in axially fixed position. The end of the spindle 52 projects outside of the cover 53 and is arranged for power transfer coupling to a drive element located outside of the cover 53. In accordance with a preferred feature of the invention, the outer end of the spindle 52 is formed as a hollow spindle in which a groove 54 is located to receive a holding spring 55. The drive shaft 56 of an electrical positioning motor 57 is coupled to the spring 55, so that power transfer between the motor 57 and the spindle 52 is ensured.

The shaft 26 has a pinion 58 secured thereto at the side adjacent the machine wall 18, and inwardly thereof. The pinion 58 is in engagement with a gear 59, secured to or formed on the end of a sleeve 60. Sleeve 60 is located in the groove or circumferential notch 21 of the bearing bushing 19 between the inner wall 22 and the outer wall 24 thereof, with sufficient play to permit rotation. The sleeve 60 is axially fixed in position. At the end of the sleeve 60 which faces the cylinder 9, sleeve 60 is secured to a movable puncture needle control cam cover disk 61 and, further, to a movable blade control cam cover disk 62. The cover disks 61, 62 are circumferentially movable or adjustable in addition to their rotary movement. Their axial position is between the fixed folding blade cam 23 and the fixed puncture needle cam 25, and so placed that the outer contours of the disks 61, 62 respectively engage the rollers 152, 162 which, via the levers 15, 16, control, respectively, the folding blade 12 and the puncture needles 10. The arrangement is such that the rotating cover cam disks are located between the fixed cams, and are adjacent each other. This arrangement has the advantage that the levers 15, 16 can be made narrower and hence lighter, and in a simpler arrangement than in prior art structures.

The roller levers 15, 16 are circumferentially offset—not shown in FIG. 2 for simplicity—and each contains two separate roller paris on respectively common axes or shafts, namely roller paris 151, 152, for engagement with the folding blade control cam 23 and cover disk 62 and roller pair 161, 162 for engagement with the needle control cam 25 and cover disk 61. One roller, each, namely rollers 151, 161 run off the fixed cams 23,25 and the other roller 162, 152, respectively, run off the cover disk camming surfaces of the cover disks 61, 62.

Figure 3:
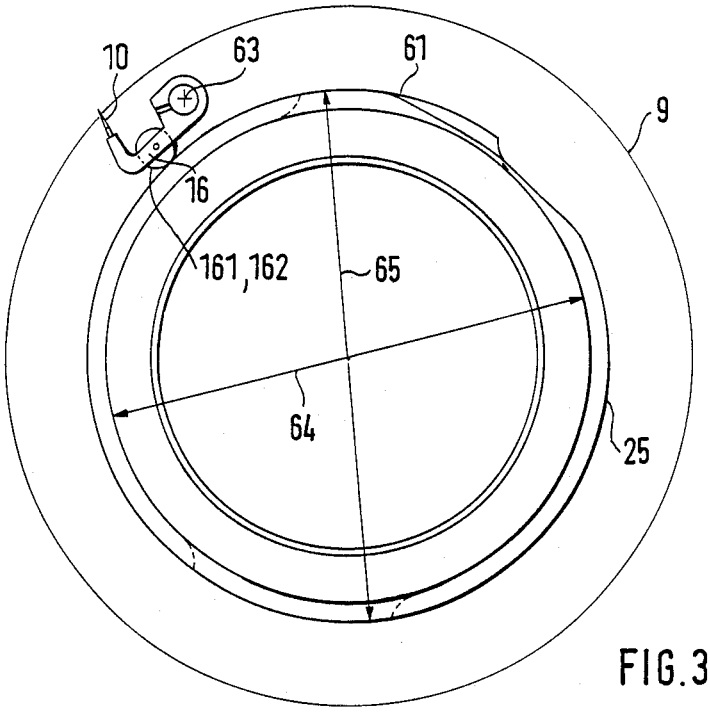
FIG. 3 is a side view illustrating the position of a puncture needle control cam and a puncture needle cover disk, and their relationships with respect to each other.
Figure 4:
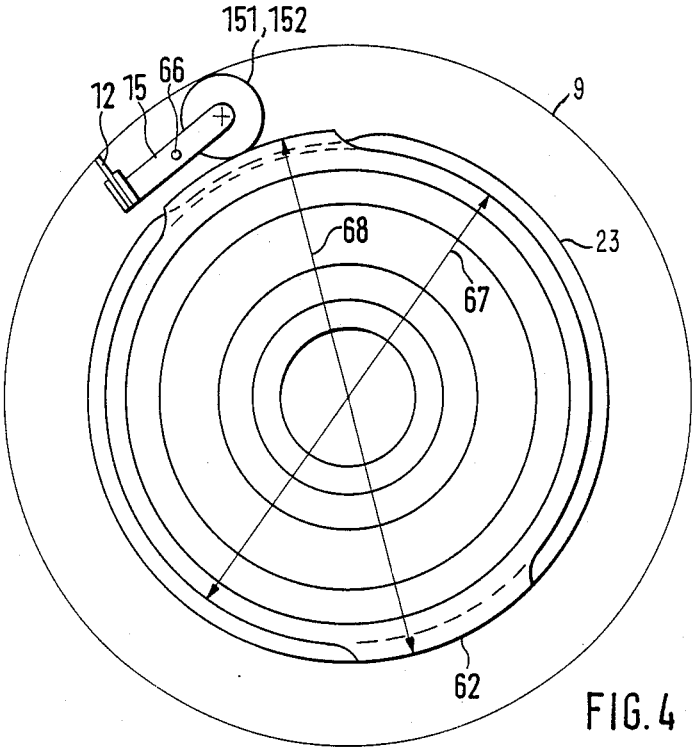
FIG. 4 is a side view showing the position of the folding blade control cam and the folding blade cover disk, and the relative positions with respect to each other.

Three circumferentially uniformly distributed folding blade systems and puncture needle systems are located on the cylinder 9; only one is shown, for simplicity, in FIGS. 3 and 4.

FIG. 3 illustrates the circumferential contours of the fixed puncture needle cam 25 and the driven puncture needle cover disk 61 which, conjointly, define a puncture needle control curve, in their cooperation with the levers 16 operating the needle system 10. The lever 16 has a pivot point 63, located on a shaft secured to the cylinder 9. The lever 16 is coupled to a cross bar or rod which carries a plurality of puncture needles 10, distributed over the width of the cylinder 9. The common shaft for the rollers 161, 162, running off the contours of the cam 25 and cover disk 61, is located between the needles 10 and the pivot point 63 of the lever 16. The needle cam 25 as well as the cover disk 61 have circumferential regions 64 of smaller diameter and regions 65 of larger diameter (FIG. 3). Cam 25 is fixed with respect to the side wall 18 of the machine; The cover disk 61, due to the transmissin ratio of the gears 20, 30, 58, 59, is driven at a speed which differs from that of the rotary speed of the cylinder 9—in the present case and as an example, at a speed of 0.75 times the cylinder speed. The roller levers 16, thus, will have a speed of operation which is different from the speed of the disks 25, 61 due to the difference in speed of the cylinder 9 with respect to the speed of disk 61. The rollers 161, 162, on one side of the lever 16, provide for projection of the needles 10 when at least one of the rollers 161 or 162 is located on the larger diameter 65 of one of the two cam surfacesof the cam 25 or the cover disk 61, respectively. The needles 10, however, are always in withdrawn position when both rollers 161, 162, at the same time, are on the smaller diameter 64 of the cam 25 and the disk 61, respectively.

A similar arrangement is provided for the folding blade 23, see FIG. 4. The folding blade cam disk 23 is fixed and the rotating folding blade cover cam disk 62, conjointly, form camming surfaces to operate the roller lever 15. Roller lever 15 has a pivot point 66 in form of a shaft secured to the cylinder 9. One end of the roller lever 15 carries the folding blade 12, extending over the entire width of the cylinder 9. The roller lever 66 has the rollers 151, 152 secured to a common shaft at the side remote from the pivot point 66, for rolling off on the cam 23 and the cover disk 62, respectively.

The folding blade cam 23 as well as the cover disk 62 have regions of small diameter 67 and regions of larger diameter 68. The cam 23 is fixed with respect to the machine side wall 18; the cover disk 63 rotates at a speed, for example, of 0.75 times the speed of the cylinder 9 due to the transmission ratio of the gears 20, 30, 58, 59. Thus, the roller levers 15 operate at a different relative speed with respect to that of the speed of the cylinder 9. Due to the arrangement of the rollers 151, 152 on the double-arm lever 15, the folding blade 12 is projected when both rollers 151, 152 simultaneously are on the smaller diameter 67 of the cam 23 and cover disk 62. The blade 12 is in withdrawn condition when at least one of the rollers 151, 152 rolls off the region of greater diameter 68 of either one of the cam 23 or cover disk 62.

The cylinder 9 is driven directly from the main gear 20 via shaft 17. The folding blade cover disk 62 and the puncture needle cover disk 61 are driven from the main drive gear 20 via the outer gearing of the hollow coupling gear 29, the cylindrical extension 31, the worm 28 and the roller bolts 36, 37 in engagement with the worm 28, and hence the shaft 26. Rotation of the shaft 26 is transferred via the pinion 58 and gear 59 on the sleeve 60 which is coupled to the disks 61, 62.

CHANGE-OVER BETWEEN OPERATING MODES

In accordance with the present invention, the shift plate 47 is shifted axially by operating the motor 57, for example from remote control. Axial shifting of the shift plate 47 causes, likewise, axial shifting of the roller bolts 36, 37 in the hollow cylindrical extension 31, which rotates the worm 28 independently of the rotation transmitted from drive gear 20. This, then, changes the relative angular position of the driven disks 61, 62 with respect to the fixed cams 23, 25. The circumferential regions with the smaller and larger diameters, respectively, thus meet at different instants of time at the respective different operating modes, thus permitting the common cross folding of a plurality of products on the cylinder or, selectively, and in accordance with the position of the shift plate 47, only single folding of a single one of the sheets.

Axial shift of the shift plate 47 is obtained by the electrical positioning motor 57, illustrated in accordance with a preferred feature of the invention. Drive shaft 56 is coupled to the spindle 52, the outer thread 51 of which, upon rotation, causes axial movement of the plate 47 due to the internal threading of bore 50. An end plate 69 limits the axial shift of the plate 47.

In accordance with a preferred feature of the invention, the shift plate 47 and/or the spindle 52 may have associated elements to monitor the respective position of the plate 47 and the end positions thereof. Such monitoring elements are, preferably, optical, electronic or opto-electronic supervisory apparatus. For such monitoring, spindle 52 is coupled to a pinion gear 70. Rotation of the pinion gear 70 is sensed by a transducer, for example a potentiometer coupled thereto, for instance through a reduction gear, to obtain an electrical feedback signal indicating the position of the plate 47. Since such monitoring apparatus, itself, is known, it is shown only schematically, coupled to gear 70. Other arrangements such as, for example, inductive sensors sensing the rotation of the gear 70 and operating digital counters can be used.

Various changes and modifications may be made within the scope of the inventive concept.

I claim:

1. Combination collection or assembling and folding cylinder (9) for sheet products having folding blades (12) controllably projectable from the cylinder;

a first control means including a fixed blade control cam (23);

a movable blade control cam cover disk (62) having a blade camming surface, said fixed blade control cam and blade cover disk conjointly defining a blade control curve;

a first pivoted cam follower (15) in controlled engagement with said blade control curve and coupled to said folding blades for controlling projection thereof;

puncture needles (10) controllably projectable from the cylinder (9);

a second control means including a fixed needle control cam (25);

a movable needle control cam cover disk (61) having a needle camming surface, said fixed needle control cam and needle cover disk conjointly defining a needle control curve;

a second pivoted cam follower (16) in controlled engagement with said needle control curve and coupled to said needles for controlling projection thereof; and means for relatively changing the angular position of said cover disks with respect to the associated cams independently of machine operation to permit change-over between operation of the cylinder, selectively, in sheet product collecting or assembling mode, or non-collecting mode, said changing means comprising a coupling gear (29) secured to a hollow shaft;

bearing means (19) journalling a cylinder shaft (17) projecting from the cylinder;

a gear (20) coupled to the cylinder shaft and driven by a main machine drive;

means (20) for driving said coupling gear (29) from the main machine drive;

adjustable means (28, 36, 37, 58, 60) for drivingly coupling disks (61, 62) to said coupling gear (29) including a worm (28) defining worm flanks, and a worm shaft (26) extending from said worm, positioned within said hollow shaft and roller bolts (36, 37) in engagement with the worm flanks and coupled to the coupling gear (29); and means (57, 56, 50) for relatively axially shifting the coupling gear (29) and hence the roller bolts on the worm to superimpose an additional rotation on said coupling gear (29) on the rotation derived from the main machine drive to thereby shift the relative angular position of the cover disks with respect to said cams.

2. The cylinder of claim 1, wherein the means for driving the coupling gear (29) from the main machine drive comprise the gear (20) which is coupled to the cylinder shaft (17).

3. The cylinder of claim 1, including a hollow cylindrical extension portion (31) coupled to the coupling gear (29);

a bearing (43) located within the hollow cylindrical extension portion, and having a fixed bearing part (46);

and wherein the axial shifting means comprises a shifting plate (47)—threaded spindle combination and threadingly engaged with a spindle (52), said fixed bearing part (46) being coupled to said shifting plate for axial shifting of the hollow cylindrical portion upon rotation of the spindle;

and wherein said roller bolts (36, 37) are retained within said hollow cylindrical portion and rotate said roller (28) upon axial shifting of said shifting plate.

4. The cylinder of claim 3, further including an electrical positioning motor (57) coupled to said spindle (52).

5. The cylinder of claim 4, further including transducer means (70, T) coupled to at least one of: said spindle; said shifting plate, to indicate the axial position of the shifting plate and provide an output signal representative thereof.

6. The cylinder of claim 5, wherein said transducer means comprises a potentiometer (T) and a gear (70) coupled to said spindle, said potentiometer being moved by said gear to indicate the position of said shifting plate.

7. The cylinder of claim 5, wherein said transducer means includes a gear (70) coupled to said spindle and transducer means (T) transducing the revolution of the gear, and hence the spindle, and providing said output signal.

8. The cylinder of claim 1, wherein the movable blade control cam cover disk (62) is located adjacent the fixed control cam (23); and the movable needle control cam cover disk (61) is located adjacent said fixed needle control cam.

9. The cylinder of claim 1, wherein the movable cover disks (61,62) are located adjacent each other, and the fixed control cams (23, 25) are located remotely from each other, with said control cam cover disks (61, 62) between the control cams (23, 25).

* * * * *